US008214927B1

(12) United States Patent
Jondahl et al.

(10) Patent No.: US 8,214,927 B1
(45) Date of Patent: Jul. 10, 2012

(54) PROTECTIVE GARMENT FOR LOWER ABDOMEN AND UPPER LEGS

(75) Inventors: Jesse Patrick Jondahl, Anoka, MN (US); Michael King, Anoka, MN (US)

(73) Assignee: Ride On Corp. Inc., Anoka, MN (US)

( * ) Notice: Subject to any disclaimer, the term of this patent is extended or adjusted under 35 U.S.C. 154(b) by 353 days.

(21) Appl. No.: 12/686,666

(22) Filed: Jan. 13, 2010

(51) Int. Cl.
*A41D 13/05* (2006.01)

(52) U.S. Cl. ..... 2/228; 2/22; 2/238; 2/270

(58) Field of Classification Search ..... 2/22, 464, 2/400, 67, 406, 2.15, 228, 238, 2.17, 79, 2/80, 82, 114, 455, 456, 2.16, 465, 466, 23, 2/46, 47, 51, 78.1, 401, 402, 404, 407, 227, 2/232, 235, 270; 602/3, 13, 23, 61–63
See application file for complete search history.

(56) References Cited

U.S. PATENT DOCUMENTS

| | | | | | |
|---|---|---|---|---|---|
| 36,125 | A | * | 8/1862 | Higgins | 2/407 |
| 973,918 | A | * | 10/1910 | Chapman | 2/228 |
| 1,003,811 | A | * | 9/1911 | Schorr | 2/228 |
| 1,232,531 | A | * | 7/1917 | Grefig | 2/228 |
| 1,308,457 | A | * | 7/1919 | Tully | 2/228 |
| 1,709,177 | A | * | 4/1929 | Kosofsky | 2/404 |
| 2,132,117 | A | * | 10/1938 | Korolick | 2/228 |
| 2,411,922 | A | * | 12/1946 | Keohane | 2/82 |
| 2,618,266 | A | * | 11/1952 | De Leone | 2/402 |
| 3,800,330 | A | | 4/1974 | Bowcut | |
| 4,017,910 | A | * | 4/1977 | Bente | 2/232 |
| 4,145,763 | A | | 3/1979 | Abrams et al. | |
| 4,506,391 | A | | 3/1985 | Rodman | |
| 4,675,918 | A | | 6/1987 | O'Brien | |
| 4,800,595 | A | * | 1/1989 | Askew | 2/270 |
| 4,894,867 | A | * | 1/1990 | Ceravolo et al. | 2/238 |
| 4,984,303 | A | | 1/1991 | Ross | |
| 5,123,120 | A | | 6/1992 | Ross | |
| 5,315,716 | A | | 5/1994 | Baum | |
| 5,359,731 | A | * | 11/1994 | Cavalier | 2/46 |
| 5,572,737 | A | * | 11/1996 | Valice | 2/465 |
| 5,598,586 | A | * | 2/1997 | Munjone | 2/237 |
| 5,706,523 | A | | 1/1998 | Witzel | |
| 5,987,779 | A | | 11/1999 | Litchfield et al. | |
| 6,049,913 | A | * | 4/2000 | Harrigan, Jr. | 2/227 |
| 6,675,389 | B1 | * | 1/2004 | Kublick | 2/2.17 |
| 7,000,261 | B1 | | 2/2006 | Loffredo | |
| D630,415 | S | * | 1/2011 | Nunn | D2/742 |
| 2006/0021115 | A1 | * | 2/2006 | Stanley | 2/400 |
| 2010/0125926 | A1 | * | 5/2010 | Simonetti et al. | 2/67 |

* cited by examiner

*Primary Examiner* — Amy Vanatta
(74) *Attorney, Agent, or Firm* — Mueting, Raasch & Gebhardt, P.A.

(57) ABSTRACT

Garments designed to be worn in conjunction with conventional chaps to protect the lower abdomen of the wearer and upper legs of a wearer are described herein. Also described are garments that replace conventional chaps.

20 Claims, 3 Drawing Sheets

PROTECTIVE GARMENT FOR LOWER ABDOMEN AND UPPER LEGS

Garments designed to protect the lower abdomen and upper legs of a wearer are described herein.

Chaps are commonly worn by, e.g., motorcyclists and others seeking protection from wind, debris, etc. Chaps do not, however, typically extend onto the lower abdomen of a rider for a variety of different reasons such as, for example, comfort (to avoid bunching or gathering of excess material, etc.), etc.

Various chap designs are described in, for example, U.S. Pat. Nos. 4,506,391 (Rodman); 4,984,303 (Ross); and others.

SUMMARY

The garments described herein are designed to be worn in conjunction with conventional chaps to protect the lower abdomen of the wearer and upper legs of a wearer.

Potential advantages of at least some embodiments of the garments described herein include, for example, the ability of a user to don the garment while wearing a pair of conventional chaps. The ability to don the garments over or under an existing pair of conventional chaps as described herein may be particularly useful because, in many instances, a rider may unexpectedly encounter rain while riding. In the event of an unplanned encounter with rain, a rider wearing a conventional pair of chaps may stop and quickly don a garment as described herein without removing his or her chaps.

As described herein, the garments are preferably made of waterproof materials such that at least the front panel of the garment resists the passage of moisture such as rain. Although essentially no garment is completely waterproof, the garments described herein preferably provide substantial protection from rain to a wearer.

In one aspect, the garments designed to protect the lower abdomen and upper legs of a wearer as described herein include: a front panel permanently connected to a rear panel, wherein the front panel and the rear panel are sized to cover a wearer from a waistband to first and second leg openings when the garment is assembled on a wearer, wherein the front panel and the rear panel are permanently connected to each other in a crotch area between the first and second leg openings, and wherein a lateral distance between the waistband and a bottom edge of each of the first and second leg openings is selected such that the garment terminates above the wearer's knees on each leg when the garment is assembled on a wearer; and a leg opening seal proximate the bottom edge of each of the first and second leg openings, wherein the leg opening seal forms a compression seal extending around an interior surface of the leg opening. The front panel and the rear panel are connected to each other along a first lateral side of the garment on a first lateral side of the wearer when the garment is worn by the wearer. The front panel and the rear panel are releasably connected to each other by a releasable connection apparatus located along a second lateral side of the garment that extends along at least a portion of the distance between the waistband and the second leg opening on a second lateral side of the wearer, wherein the releasable connection apparatus comprises a connected configuration in which the front panel and the rear panel are connected to each other along the second lateral side of the garment and a detached configuration in which the front panel and the rear panel are not connected to each other along the second lateral side of the garment.

In some embodiments, the front panel and the rear panel of the garments described herein are permanently connected to each other along the first lateral side of the garment.

In some embodiments, the leg opening seal of the garments described herein comprises a cinching element comprising a loosened configuration and a tightened configuration, wherein the cinching element compresses the interior surface of the leg opening against the wearer to form the compression seal when in the tightened configuration. In some embodiments, the compression seal is not formed when the cinching element is in the loosened configuration. In some embodiments, the cinching element is in tension when in the tightened configuration. In some embodiments, at least a portion of the cinching element is located within a sleeve that extends around a portion of the leg opening.

In some embodiments, the leg opening seal of the garments described herein comprises a resilient gasket member on the interior surface of the leg opening.

In some embodiments, the leg opening seal of the garments described herein comprises an inflatable bladder extending at least partially around the leg opening.

In some embodiments, the garments described herein include a cover flap extending over the releasable connection apparatus when the garment is assembled on a wearer, wherein the cover flap is fixedly attached to the front panel of the garment.

In some embodiments of the garments described herein, the releasable connection apparatus is selected from the group consisting of: zippers, hook and loop closure systems, adhesives, snap fasteners, buttons, ties, and clips.

In some embodiments of the garments described herein, the front panel and the rear panel are permanently connected to each other along the entire first lateral side of the garment along a line extending from the waistband to the bottom edge of the first leg opening.

In some embodiments of the garments described herein, the front panel and the rear panel are permanently connected to each other along only a first portion of the first lateral side of the garment, and wherein the garment further comprises a supplemental releasable connection apparatus connecting the front panel to the rear panel along a second portion of the first lateral side of the garment, wherein the first portion and the second portion taken together extend from the waistband to the bottom edge of the first leg opening; wherein the supplemental releasable connection apparatus comprises a connected configuration in which the front panel and the rear panel are connected to each other by the supplemental releasable connection apparatus and a detached configuration in which the front panel and the rear panel are not connected to each other by the supplemental releasable connection apparatus. In some embodiments, the supplemental releasable connection apparatus extends from the bottom edge of the first leg opening towards the waistband. In some embodiments, the garments may include a cover flap extending over the supplemental releasable connection apparatus when the garment is assembled on a wearer, wherein the cover flap is fixedly attached to the front panel of the garment. In some embodiments, the supplemental releasable connection apparatus is selected from the group consisting of: zippers, hook and loop closure systems, adhesives, snap fasteners, buttons, ties, and clips.

In some embodiments of the garments described herein the releasable connection apparatus located along the second lateral side of the garment extends along a line that is canted relative to a medial centerline of the wearer.

In some embodiments of the garments described herein the front panel is waterproof when the garment is assembled on a wearer such that water entry through the front panel is substantially prevented in normal use. In some embodiments, the front panel comprises waterproof leather.

In another aspect, the garments designed to protect the lower abdomen and upper legs of a wearer as described herein include: a front panel permanently connected to a rear panel, wherein the front panel and the rear panel are sized to cover a wearer from a waistband to first and second leg openings when the garment is assembled on a wearer, wherein the front panel and the rear panel are permanently connected to each other in a crotch area between the first and second leg openings, and wherein a lateral distance between the waistband and a bottom edge of each of the first and second leg openings is selected such that the garment terminates above the wearer's knees on each leg when the garment is assembled on a wearer; a leg opening seal proximate the bottom edge of each of the first and second leg openings, wherein the leg opening seal forms a compression seal extending around an interior surface of the leg opening, wherein the leg opening seal comprises a cinching element comprising a loosened configuration and a tightened configuration, wherein the cinching element compresses the interior surface of the leg opening against the wearer to form the compression seal when in the tightened configuration, and wherein the compression seal is not formed when the cinching element is in the loosened configuration, and further wherein the cinching element is in tension when in the tightened configuration. The front panel and the rear panel are permanently connected to each other along a first lateral side of the garment, wherein the front panel and the rear panel are permanently connected to each other along the entire first lateral side of the garment along a line extending from the waistband to the bottom edge of the first leg opening. The front panel and the rear panel are releasably connected to each other by a releasable connection apparatus located along a second lateral side of the garment that extends along at least a portion of the distance between the waistband and the second leg opening on a second lateral side of the wearer, wherein the releasable connection apparatus comprises a connected configuration in which the front panel and the rear panel are connected to each other along the second lateral side of the garment and a detached configuration in which the front panel and the rear panel are not connected to each other along the second lateral side of the garment.

In another aspect, the garments designed to protect the lower abdomen and upper legs of a wearer as described herein include: a front panel permanently connected to a rear panel, wherein the front panel and the rear panel are sized to cover a wearer from a waistband to first and second leg openings when the garment is assembled on a wearer, wherein the front panel and the rear panel are permanently connected to each other in a crotch area between the first and second leg openings, and wherein a lateral distance between the waistband and a bottom edge of each of the first and second leg openings is selected such that the garment terminates above the wearer's knees on each leg when the garment is assembled on a wearer; and a leg opening seal proximate the bottom edge of each of the first and second leg openings, wherein the leg opening seal forms a compression seal extending around an interior surface of the leg opening, wherein the leg opening seal comprises a cinching element comprising a loosened configuration and a tightened configuration, wherein the cinching element compresses the interior surface of the leg opening against the wearer to form the compression seal when in the tightened configuration, and wherein the compression seal is not formed when the cinching element is in the loosened configuration, and further wherein the cinching element is in tension when in the tightened configuration. The front panel and the rear panel are permanently connected to each other along a first lateral side of the garment, wherein the front panel and the rear panel are permanently connected to each other along only a first portion of the first lateral side of the garment, and wherein the garment further comprises a supplemental releasable connection apparatus connecting the front panel to the rear panel along a second portion of the first lateral side of the garment, wherein the first portion and the second portion taken together extend from the waistband to the bottom edge of the first leg opening; wherein the supplemental releasable connection apparatus comprises a connected configuration in which the front panel and the rear panel are connected to each other by the supplemental releasable connection apparatus and a detached configuration in which the front panel and the rear panel are not connected to each other by the supplemental releasable connection apparatus. The front panel and the rear panel are releasably connected to each other by a releasable connection apparatus located along a second lateral side of the garment that extends along at least a portion of the distance between the waistband and the second leg opening on a second lateral side of the wearer, wherein the releasable connection apparatus comprises a connected configuration in which the front panel and the rear panel are connected to each other along the second lateral side of the garment and a detached configuration in which the front panel and the rear panel are not connected to each other along the second lateral side of the garment.

In one aspect, a method of protecting the lower abdomen and upper legs of a wearer may include donning a garment as described herein such that the front panel is proximate the lower abdomen and the right and left legs are located within the first and second leg openings of the garment, and wherein the bottom edges of the first and second leg openings extend over a top edge of a pair of chaps on the right and left legs; closing the releasable connection apparatus along the second lateral side of the garment; and forming a compression seal around the first and second leg openings, wherein, on each leg, an upper edge of the chap is compressed between the leg of a wearer and the leg opening seal.

In some embodiments, the method may further include closing a supplemental releasable connection apparatus along the first lateral side of the garment.

The above summary is not intended to describe each embodiment or every implementation of the garments described herein. Rather, a more complete understanding of the garments will become apparent and appreciated by reference to the following Description of Illustrative Embodiments and claims in view of the accompanying figures of the drawing.

BRIEF DESCRIPTION OF THE VIEWS OF THE DRAWING

The present invention will be further described with reference to the figures of the drawing, wherein.

DESCRIPTION OF ILLUSTRATIVE EMBODIMENTS

Figure 1:
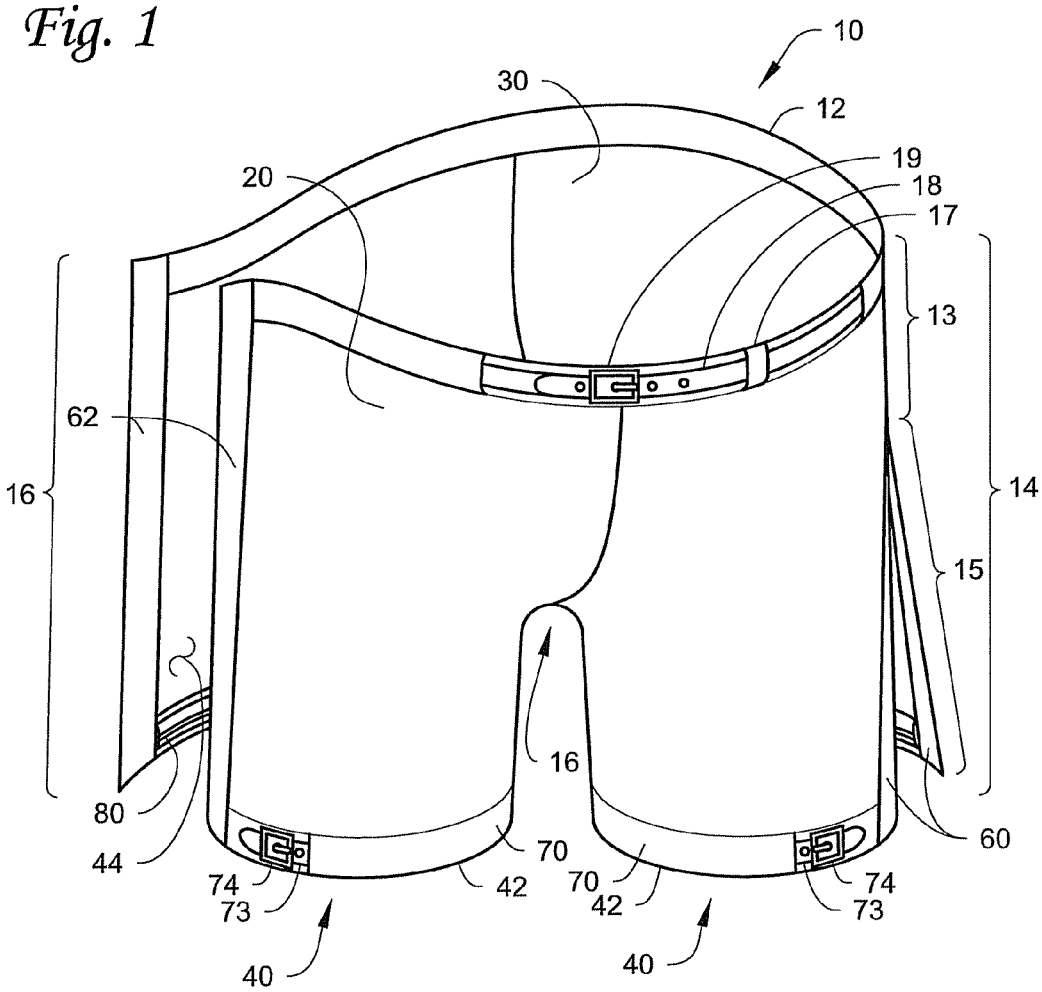
FIG. 1 is a perspective view of one embodiment of a garment as described herein.

In the following detailed description of illustrative embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the present invention.

One illustrative embodiment of a garment as described herein is depicted in FIG. 1 in the form of a perspective view taken from a front of the garment 10. The garment 10 includes a waistband 12, a front panel 20, and a rear panel 30. Although the front panel 20 and the rear panel 30 are described as panels, it should be understood that they may be constructed a variety of smaller pieces that are connected to each other to form a composite article that functions as the front panel 20 or rear panel 30.

The front panel 20 and the rear panel 30 can be connected to each other to form a garment 10 that in many respect, resembles a pair of shorts that include leg openings 40. The garment 10 may, for example, be described as having a lateral distance between the waistband 12 and the bottom edges 42 of each of the right and left leg openings 40 that is selected such that the garment 10 terminates above a wearer's knees when the garment 10 is assembled on the wearer (in the manner of a pair of shorts).

The front panel 20 is permanently connected to the rear panel 30 to form the garment 10. The front panel 20 and the rear panel 30 are preferably permanently connected to each other in a crotch area 16 that is located between the right and left leg openings 40.

In some embodiments, such as the illustrative embodiment depicted in FIG. 1, the front panel 20 and the rear panel 30 are also permanently connected to each other along a lateral side 14 of the garment 10 which corresponds with a lateral side of a wearer on which the garment 10 is assembled.

As used herein, the phrase "permanently connected" (and variations thereof) mean that the components (for example, the front panel 20 and the rear panel 30) are connected in a manner that would require destruction, mutilation, etc. of one or both of the components to separate them from each other. For example, two components that are connected along a seam that is stitched, glued, etc. are permanently connected because one or both of the components (and/or a component connecting them) would need to be destroyed, mutilated, etc. to separate the components.

Although in some embodiments, the front panel 20 and the rear panel 30 may be permanently connected to each other along substantially the entire first lateral side 14 of the garment 10, the illustrative embodiment depicted in FIG. 1 is permanently connected along only a portion 13 of the lateral side 14. The front panel 20 and the rear panel 30 of the illustrative embodiment of garment 10 can be releasably connected to each other along the remaining portion 15 of the lateral side 14 of the garment 10 using a releasable connection apparatus 60. The portion 13 and the portion 15 of the first lateral side 14 of the garment 10 preferably, when taken together, extend from the waistband 12 to the bottom edge 42 of the leg opening 40 along the lateral side 14 of the garment 10.

The releasable connection apparatus 60 has a connected configuration in which the front panel 20 and the rear panel 30 are connected to each other by the releasable connection apparatus 60 (not shown) and a detached configuration as shown in which the front panel 20 and the rear panel 30 are not connected to each other by the supplemental releasable connection apparatus 60. In the depicted embodiment of the garment 10, the releasable connection apparatus 60 extends from the bottom edge 42 of the leg opening 40 towards the waistband 12, although the position of the releasable connection apparatus 60 may be reversed (i.e., it may extend from the waistband 12 towards the leg opening 40 while the permanent connection extends from the leg opening 40 towards the waistband).

The illustrative embodiment of garment 10 depicted in FIG. 1 also includes releasable connection 62 on the lateral side 16 of the garment 10 (where the lateral side 16 is on the opposite side of the garment 10 from the lateral side 14). The front panel 20 and the rear panel 30 are releasably connected to each other by the releasable connection apparatus 62 on the lateral side 16 of the garment 10. The releasable connection apparatus 62 extends along at least a portion of the distance between the waistband 12 and the bottom edge 42 of the leg opening 40 on lateral side 16, although it may preferably extend along substantially the entire lateral side from the waistband 12 to the leg opening 40. The releasable connection apparatus 62 has a connected configuration (not shown in FIG. 1) in which the front panel 20 and the rear panel 30 are connected to each other along the lateral side 16 of the garment 10 and a detached configuration (shown in FIG. 1) in which the front panel 20 and the rear panel 30 are not connected to each other along the lateral side 16 of the garment 10.

When both releasable connection apparatus 60 on lateral side 14 and releasable connection apparatus 62 on lateral side 16 are in their respective connected configurations, the garment 10 can be described as assembled and, if worn by a wearer, would take the general foam of a pair of shorts.

The releasable connection apparatus 60 and 62 are both useful for allowing a user to easily don the garment 10 without requiring the removal of other clothing such as, for example, chaps, pants, etc. Although the releasable connection apparatus 60 on lateral side 14 is optional (i.e., the front panel 20 and the rear panel 30 may be permanently connected along the entire lateral side 14), providing the releasable connection apparatus 60 on the lateral side 14 in addition to the releasable connection apparatus 62 on the opposing lateral side 16 may make it easier for a wearer to put on and/or remove the garment 10.

The releasable connection apparatus 60 and 62 can take a number of different fauns, at least some of which will be described below in connection with FIGS. 4A and 4B.

With respect to the illustrative embodiment of garment 10 depicted in FIG. 1, another feature depicted there are leg opening seals 70 located proximate the bottom edges 42 of the leg openings 40 of the garment 10. The leg opening seals 70 preferably form a compression seal that extends around the interior surfaces 44 of the leg openings 40. The leg opening seals 70 are preferably capable of resisting the passage of water (for example, rain, etc.) between the interior surfaces 44 of the leg openings 40 and the underlying clothing and/or skin of a wearer.

In the illustrative embodiment of garment 10 depicted in FIG. 1, the leg opening seals 70 may include a cinching apparatus in the form of a belt or strap 73 that extends around a significant portion of the leg opening 40 and that can be tightened using, for example, a buckle 74 to provide the compression that assists in the formation of the compression seal described herein.

The cinching apparatus preferably has a loosened configuration and a tightened configuration. The cinching apparatus is depicted in the loosened configuration in FIG. 1. In at least some embodiments, the compression seal is not formed when the cinching apparatus is in the loosened configuration. In the tightened configuration, the cinching apparatus compresses the interior surface 44 of the leg opening 40 against the wearer to form the compression seal when the cinching apparatus is in the tightened configuration. In at least some embodiments, the cinching apparatus is in tension when in the tightened configuration. The size of the leg opening 40 is preferably smaller when the cinching apparatus is in the tightened configuration than when the cinching apparatus is in the loosened configuration.

In some embodiments, the leg opening seal 70 may include a resilient gasket member 80 on the interior surface 44 of the leg opening 40. The gasket member 80 may, for example, be constructed of an elastomeric polymer (e.g., silicone, etc.) that assists in preventing the infiltration of water underneath the interior surface 44 of the leg opening 40.

Figure 2:
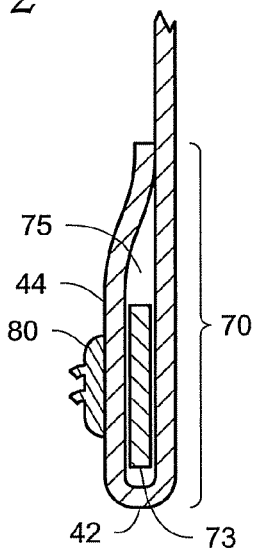
FIG. 2 is an enlarged cross-sectional view of the garment of FIG. 1 taken along line 2-2 in FIG. 1.

In the illustrative embodiment of cinching apparatus as depicted in FIG. 1, at least a portion of the belt 73 of the depicted embodiment of cinching apparatus may be located within a sleeve that extends around at least a portion of the leg opening 40. FIG. 2 is an enlarged cross-sectional view taken along line 2-2 in FIG. 1 and depicts the belt 73 located within a sleeve 75 formed above the bottom edge 42 of the leg opening 40. Also depicted in FIG. 2 is the illustrative embodiment of gasket member 80. The belt 73 may be fixedly or permanently attached to the material forming the sleeve only at its ends to provide for movement of the belt 73 within the sleeve 75 during the tightening and loosening processes.

Figure 3:
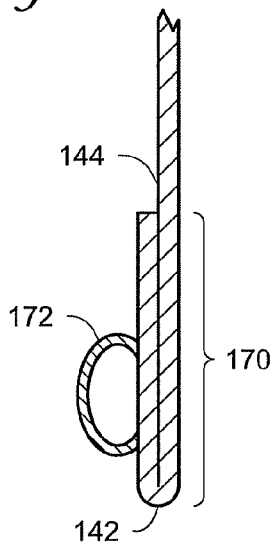
FIG. 3 is an enlarged cross-sectional view of an alternative leg opening seal.

FIG. 3 is an enlarged cross-sectional view of another embodiment of leg opening seal that may be provided in connection with the garments described herein. The leg opening seal 170 depicted in FIG. 3 may include an inflatable bladder 172 that can be expanded to provide a compression seal that can reduce leakage between the interior surface 144 and the leg of a wearer. Inflatable bladders and the mechanisms for inflating and deflating them are described in, e.g., U.S. Pat. No. 5,987,779 (Litchfield et al.). In the embodiments of leg opening seals described herein that include an inflatable bladder, the use of a cinching apparatus may be optional, i.e., a cinching apparatus may or may not be provided in addition to the inflatable bladder.

As discussed herein, the garments preferably include one or more releasable connection apparatus to make it easier to put on and/or remove the garments. The releasable connection apparatus can take many different forms so long as the apparatus can perform its basic function of connecting the front panels and the rear panels of the garments described herein. As discussed herein, the releasable connection apparatus may be provided in the form of, for example, mechanical sheet fastener materials (e.g., hook and loop fasteners (e.g., VELCRO, etc.), stem fasteners, etc.), zippers, buttons, snap fasteners, ties, magnetic fasteners, etc.

Figure 4A:
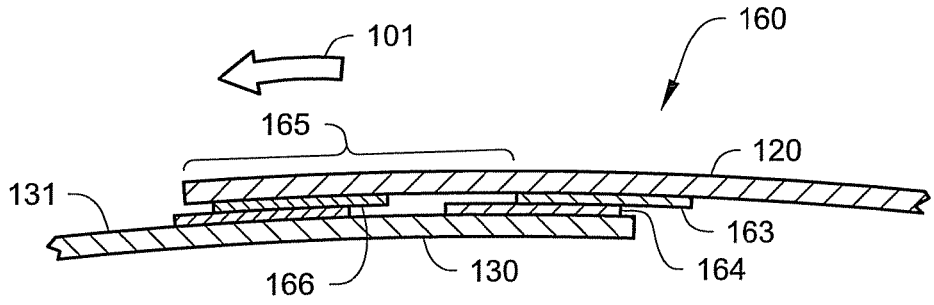
FIG. 4A is an enlarged cross-sectional view of one embodiment of a releasable connection apparatus that may be used in connection with the garments described herein.

One illustrative embodiment of a releasable connection apparatus 160 that may be used in connection with the garments described herein is depicted in a cross-sectional view in FIG. 4A, wherein the cross-sectional plane is oriented transverse to the line along which the connection is made between the front panel 120 and rear panel 130. The depicted embodiment of releasable connection apparatus 160 includes one component 163 of a mechanical sheet fastener material attached to the front panel 120 and the mating component 164 of the mechanical sheet fastener material attached to the rear panel 130.

The mechanical sheet fastener materials of components 163 and 164 may be, e.g. hook and loop closure materials, interlocking stem fastener sheets, etc. The components 163 and 164 may be attached to the front and rear panels 120 and 130 by any suitable technique, e.g., stitching, adhesives, melt bonding, etc. A potential advantage of the mechanical sheet fasteners is that the fit of the garment may potentially be adjusted by adjusting the position of the components relative to each other.

Another optional feature depicted in FIG. 4A is the addition of a cover flap 165 attached to the front panel 120. The cover flap 165 preferably extends past the line along which the front panel 120 is connected to the rear panel by the connection apparatus 160, such that the cover flap 165 is located over an exterior surface 131 of the rear panel 130.

The addition of a cover flap 165 may assist in prevent leakage through the connection between the front panel 120 and the rear panel 130, particularly where air, etc. may be moving at relatively high speeds over that connection in the direction of arrow 101. In such a situation, the cover flap 165 shelters the connection.

To assist in holding the cover flap 165 in position, the garment may include an auxiliary fastener 166 to hold the flap 165 against the exterior surface 131 of the rear panel 130. The auxiliary fastener 166 may take any suitable form, e.g., mechanical sheet fastener materials (e.g., hook and loop fasteners (e.g., VELCRO, etc.), stem fasteners, etc.), zippers, buttons, snap fasteners, ties, magnetic fasteners, etc. In the depicted embodiment, the auxiliary fastener 166 may take the form of magnetic elements affixed to each of the rear panel 130 and the flap 165.

Figure 4B:
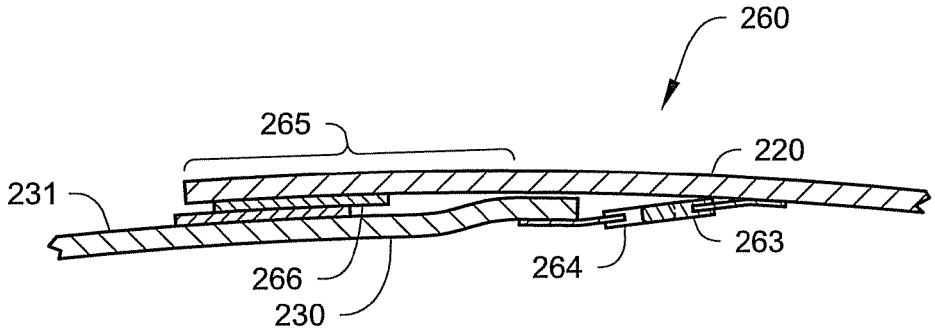
FIG. 4B is an enlarged cross-sectional view of another embodiment of a releasable connection apparatus that may be used in connection with the garments described herein.

Another illustrative embodiment of a releasable connection apparatus 260 that may be used in connection with the garments described herein is depicted in a cross-sectional view in FIG. 4B, wherein the cross-sectional plane is oriented transverse to the line along which the connection is made between the front panel 220 and rear panel 230. The depicted embodiment of releasable connection apparatus 260 includes a zipper that includes one component 263 attached to the front panel 220 and the mating component 264 attached to the rear panel 230.

The embodiment depicted in FIG. 4B also includes an optional cover flap 265 attached to the front panel 220. The garment may also include an auxiliary fastener 266 to hold the flap 265 against the exterior surface 231 of the rear panel 230 as described herein.

Referring back to FIG. 1, among the features depicted in connection with the garment depicted there is a belt 18 with a buckle 19 located proximate the waistband 12. The belt 18 and buckle 19 can be used to secure the waistband 12 of the garment 10 around the waist of a wearer. The belt 18 may be located with a sleeve that extends around the waistband 12 or, as in the depicted embodiment, belt loops 17 may be provided.

Figure 5:
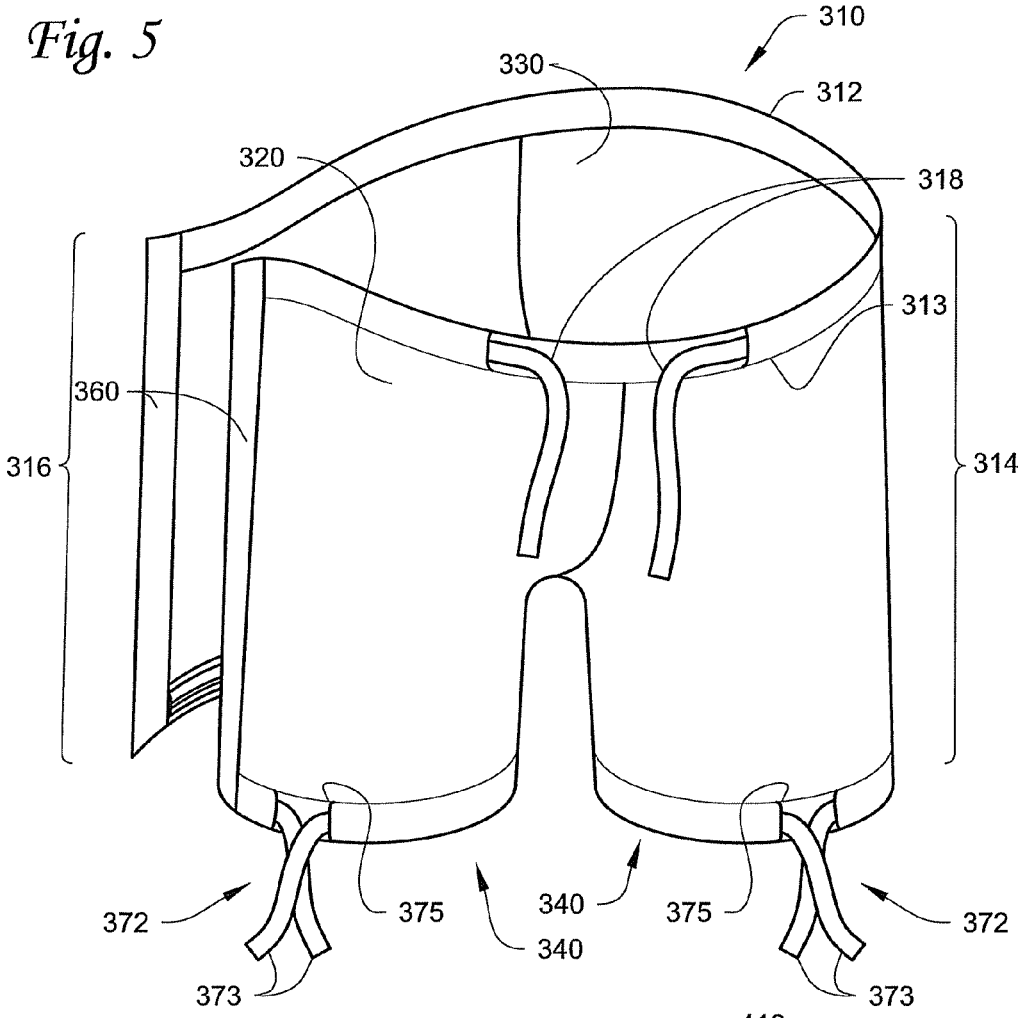
FIG. 5 is a perspective view of another embodiment of a garment as described herein.

Many other structures may be used in place of the belt to secure the garments described herein around the waist of a wearer. The illustrative embodiment of garment 310 as depicted in FIG. 5 includes one alternative in the form of ties 318 that may be threaded through sleeves 313 that extend around the waistband 312 of the garment 310.

The garment 310 also includes an alternative cinching apparatus 372 in the form of ties 373 that are located in sleeves 375 that extend around the leg openings 340 of the garment 310.

It should be noted that garment 310 is also an illustrative embodiment of a garment described herein that includes a front panel 320 connected to a rear panel 330 along substantially the entire lateral side 314 of the garment 310 from the waistband 312 to the leg opening 340. The opposite lateral side 316 of the garment 310 includes a releasable connection apparatus 360 similar to the garment 10 described in connection with FIG. 1 to assist a user with putting on and/or removing the garment 310.

Another variation depicted in connection with the illustrative embodiment of garment 310 is that the orientation of the releasable connection apparatus may not be vertical as depicted in the embodiment of FIG. 1. In other words, the releasable connection apparatus 360 and the edges of the front panel 320 and the rear panel 330 connected by the apparatus 360 may extend at an angle relative to a vertical lateral line of the wearer. As a result, the upper end of the releasable connection apparatus 360 (that is, the end by the waistband 312) may be located along the front of the wearer while the lower end of the releasable connection apparatus 360 (that is, the end by the bottom of the leg opening 340) may be located along the side and/or back of the wearer's thigh) (or vice versa). Such an orientation of the releasable connection apparatus can be described as "canted"—which may alternately be characterized as extending along a line that extends in a direction that is not aligned (e.g., parallel or substantially parallel) with the medial centerline of the wearer.

Although the illustrative embodiments of garments 10 and 310 depicted in FIGS. 1 and 5 include releasable connection apparatus that extend from the waistbands to the bottoms of the right legs while at least a portion of the front and rear panels are permanently connected to each other on the left sides of the garments, it should be understood that the arrangements could be changed, i.e., a garment could be provided with permanent connections along the right side and releasable connections along the left side.

Further, although the garments are described as having front and rear panels that connect along the lateral sides of the garment, the precise locations of the connections may vary, i.e., the front and rear panels may not extend equally around the user such that the connections may be located either forward of or to the rear of the exact lateral lines of the wearer along the right and/or left side of the wearer.

Figure 6:
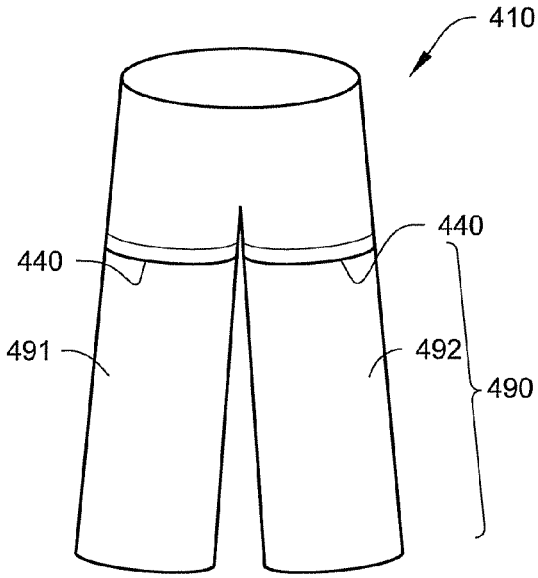
FIG. 6 depicts another embodiment of a garment as described herein.

Yet another illustrative embodiment of the garments described herein is depicted in FIG. 6. The garment 410 may be designed for use with a longer garment 490 such as, e.g., a pair of chaps and the two garments 410 and 490 may include cooperating elements to limit infiltration of water, etc. at the junction between the bottoms of the leg openings 440 and the upper ends of the legs 491 and 492 of the chaps 490. Such cooperating elements may include, e.g., mating gasket members, mechanical fastener sheet materials, snaps, buttons, zippers, etc. In some embodiments, the upper edges of the legs 491 and 492 may preferably extend over the exterior surface of the leg openings to create a flap that may be, for example, constructed similarly to the flaps depicted and described in connection with FIGS. 4A and 4B.

In addition, FIG. 6 may also be used to described one embodiment of a method donning a garment as described herein over a pair of conventional chaps. The method may include donning garment 410 such that the front panel of the garment is proximate the lower abdomen of a wearer and the right and left legs are located within the first and second leg openings of the garment. The bottom edges of the first and second leg openings may preferably extend over the top edge of the chaps 490 on the right and left legs 491 and 492. The method may further include closing a releasable connection apparatus along the second lateral side of the garment (see, e.g., FIGS. 1 & 5 and the corresponding discussions); and forming a compression seal around the first and second leg openings, wherein, on each leg, an upper edge of the chap is compressed between the leg of a wearer and the leg opening seal on the inner surface of the leg opening.

In those garments that include a supplemental releasable connection apparatus on the first lateral side of the garment (see, e.g., FIG. 1 and the corresponding discussion), the method may also include closing a supplemental releasable connection apparatus along the first lateral side of the garment.

The garments described herein may be made any suitable material or combination of materials. It may be preferred that at least the front panels be constructed of waterproof materials, while the rear panels may or may not be constructed of waterproof materials. As used herein, the term "waterproof" includes materials that may be permeable to liquid water under extreme conditions, but that will be otherwise impermeable to liquid water under the conditions of normal use for the garments described herein (which may include traveling at high rates of speed during rainstorms). Examples of some potentially suitable waterproof materials for the garments described herein may include, but are not limited to, waterproof leathers, waterproof fabrics (e.g., GORE-TEX and similar fabrics), etc.

Although not depicted, it should be understood that the garments described herein may include additional features such as, e.g., one or more pockets, a fly, etc. that may potentially enhance use of the garment.

The complete disclosure of the patents, patent documents, and publications cited herein are incorporated by reference in their entirety as if each were individually incorporated.

Illustrative embodiments of this invention are discussed and reference has been made to possible variations within the scope of this invention. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A garment designed to protect the lower abdomen and upper legs of a wearer, the garment comprising:

a front panel permanently connected to a rear panel, wherein the front panel and the rear panel are sized to cover a wearer from a waistband to first and second leg openings when the garment is assembled on a wearer, wherein the front panel and the rear panel are permanently connected to each other in a crotch area between the first and second leg openings, and wherein a lateral distance between the waistband and a bottom edge of each of the first and second leg openings is selected such that the garment terminates above the wearer's knees on each leg when the garment is assembled on a wearer;

a leg opening seal proximate the bottom edge of each of the first and second leg openings, wherein the leg opening seal forms a compression seal extending around an interior surface of the leg opening;

wherein the front panel and the rear panel are connected to each other along a first lateral side of the garment on a first lateral side of the wearer when the garment is worn by the wearer;

and wherein the front panel and the rear panel are releasably connected to each other by a releasable connection apparatus located along a second lateral side of the garment that extends along at least a portion of the distance between the waistband and the second leg opening on a second lateral side of the wearer, wherein the releasable connection apparatus comprises a connected configuration in which the front panel and the rear panel are connected to each other along the second lateral side of the garment and a detached configuration in which the front panel and the rear panel are not connected to each other along the second lateral side of the garment.

2. A garment according to claim 1, wherein the front panel and the rear panel are permanently connected to each other along the first lateral side of the garment.

3. A garment according to claim 1, wherein the leg opening seal comprises a cinching element comprising a loosened configuration and a tightened configuration, wherein the cinching element compresses the interior surface of the leg opening against the wearer to form the compression seal when in the tightened configuration.

4. A garment according to claim 3, wherein the compression seal is not formed when the cinching element is in the loosened configuration.

5. A garment according to claim 3, wherein the cinching element is in tension when in the tightened configuration.

6. A garment according to claim 3, wherein at least a portion of the cinching element is located within a sleeve that extends around a portion of the leg opening.

7. A garment according to claim 1, wherein the leg opening seal comprises a resilient gasket member on the interior surface of the leg opening.

8. A garment according to claim 1, wherein the leg opening seal comprises an inflatable bladder extending at least partially around the leg opening.

9. A garment according to claim 1, further comprising a cover flap extending over the releasable connection apparatus when the garment is assembled on a wearer, wherein the cover flap is fixedly attached to the front panel of the garment.

10. A garment according to claim 1, wherein the front panel and the rear panel are permanently connected to each other along the entire first lateral side of the garment along a line extending from the waistband to the bottom edge of the first leg opening.

11. A garment according to claim 1, wherein the front panel and the rear panel are permanently connected to each other along only a first portion of the first lateral side of the garment, and wherein the garment further comprises a supplemental releasable connection apparatus connecting the front panel to the rear panel along a second portion of the first lateral side of the garment, wherein the first portion and the second portion taken together extend from the waistband to the bottom edge of the first leg opening; wherein the supplemental releasable connection apparatus comprises a connected configuration in which the front panel and the rear panel are connected to each other by the supplemental releasable connection apparatus and a detached configuration in which the front panel and the rear panel are not connected to each other by the supplemental releasable connection apparatus.

12. A garment according to claim 11, wherein the supplemental releasable connection apparatus extends from the bottom edge of the first leg opening towards the waistband.

13. A garment according to claim 11, further comprising a cover flap extending over the supplemental releasable connection apparatus when the garment is assembled on a wearer, wherein the cover flap is fixedly attached to the front panel of the garment.

14. A garment according to claim 1, wherein the releasable connection apparatus located along the second lateral side of the garment extends along a line that is canted relative to a medial centerline of a wearer.

15. A garment according to claim 1, wherein the front panel is waterproof when the garment is assembled on a wearer such that water entry through the front panel is substantially prevented in normal use.

16. A garment according to claim 15, wherein the front panel comprises waterproof leather.

17. A garment designed to protect the lower abdomen and upper legs of a wearer, the garment comprising:

a front panel permanently connected to a rear panel, wherein the front panel and the rear panel are sized to cover a wearer from a waistband to first and second leg openings when the garment is assembled on a wearer, wherein the front panel and the rear panel are permanently connected to each other in a crotch area between the first and second leg openings, and wherein a lateral distance between the waistband and a bottom edge of each of the first and second leg openings is selected such that the garment terminates above the wearer's knees on each leg when the garment is assembled on a wearer;

a leg opening seal proximate the bottom edge of each of the first and second leg openings, wherein the leg opening seal forms a compression seal extending around an interior surface of the leg opening, wherein the leg opening seal comprises a cinching element comprising a loosened configuration and a tightened configuration, wherein the cinching element compresses the interior surface of the leg opening against the wearer to form the compression seal when in the tightened configuration, and wherein the compression seal is not formed when the cinching element is in the loosened configuration, and further wherein the cinching element is in tension when in the tightened configuration;

wherein the front panel and the rear panel are permanently connected to each other along only a first portion of a first lateral side of the garment, and wherein the garment further comprises a supplemental releasable connection apparatus connecting the front panel to the rear panel along a second portion of the first lateral side of the garment, wherein the first portion and the second portion taken together extend from the waistband to the bottom edge of the first leg opening; wherein the supplemental releasable connection apparatus comprises a connected configuration in which the front panel and the rear panel are connected to each other by the supplemental releasable connection apparatus and a detached configuration in which the front panel and the rear panel are not connected to each other by the supplemental releasable connection apparatus;

and wherein the front panel and the rear panel are releasably connected to each other by a releasable connection apparatus located along a second lateral side of the garment that extends along at least a portion of the distance between the waistband and the second leg opening on a second lateral side of the wearer, wherein the releasable connection apparatus comprises a connected configuration in which the front panel and the rear panel are connected to each other along the second lateral side of the garment and a detached configuration in which the front panel and the rear panel are not connected to each other along the second lateral side of the garment.

18. A garment according to claim 17, wherein the leg opening seal comprises an inflatable bladder extending at least partially around the leg opening.

19. A method of protecting the lower abdomen and upper legs, the method comprising:

donning a garment as recited in claim 1 such that the front panel is proximate the lower abdomen and the right and left legs are located within the first and second leg openings of the garment, and wherein the bottom edges of the first and second leg openings extend over a top edge of a pair of chaps on the right and left legs;

closing the releasable connection apparatus along the second lateral side of the garment; and forming a compression seal around the first and second leg openings, wherein, on each leg, an upper edge of the chap is compressed between the leg of a wearer and the leg opening seal.

20. A method according to claim 19, wherein the method further comprises closing a supplemental releasable connection apparatus along the first lateral side of the garment.

* * * * *